US008766075B2

(12) United States Patent
Ishida

(10) Patent No.: US 8,766,075 B2
(45) Date of Patent: Jul. 1, 2014

(54) KEYBOARD DEVICE FOR ELECTRONIC KEYBOARD INSTRUMENT

(71) Applicant: Kabushiki Kaisha Kawai Gakki Seisakusho, Hamamatsu (JP)

(72) Inventor: Hideyuki Ishida, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 13/712,802

(22) Filed: Dec. 12, 2012

(65) Prior Publication Data

US 2013/0180390 A1 Jul. 18, 2013

(30) Foreign Application Priority Data

Jan. 13, 2012 (JP) ..... 2012-005033
Jan. 13, 2012 (JP) ..... 2012-005034
Jan. 13, 2012 (JP) ..... 2012-005035

(51) Int. Cl.
*G10C 3/12* (2006.01)
*G10H 1/34* (2006.01)

(52) U.S. Cl.
CPC .. *G10H 1/34* (2013.01); *G10C 3/12* (2013.01); *G10H 1/346* (2013.01)
USPC ..... 84/423 R; 84/433

(58) Field of Classification Search
CPC ..... G10C 3/12
USPC ..... 84/423 R, 433
See application file for complete search history.

(56) References Cited

U.S. PATENT DOCUMENTS

| | | | | |
|---|---|---|---|---|
| 5,406,875 | A * | 4/1995 | Tamai et al. | 84/433 |
| 5,542,332 | A * | 8/1996 | Tamai et al. | 84/435 |
| 6,191,351 | B1 * | 2/2001 | Niitsuma | 84/720 |
| 6,617,502 | B2 * | 9/2003 | Suzuki et al. | 84/423 R |
| 6,653,542 | B2 * | 11/2003 | Suzuki et al. | 84/423 R |
| 6,875,913 | B2 * | 4/2005 | Bubar | 84/423 R |
| 7,514,613 | B2 * | 4/2009 | Yamaguchi | 84/236 |
| 7,550,659 | B2 * | 6/2009 | Shimoda | 84/251 |
| 7,977,561 | B2 * | 7/2011 | Folkesson | 84/615 |
| 8,119,895 | B2 * | 2/2012 | Kitajima | 84/423 R |
| 8,258,389 | B2 * | 9/2012 | Suzuki | 84/441 |
| 8,440,896 | B2 * | 5/2013 | Hoshino | 84/433 |
| 2013/0152769 | A1 * | 6/2013 | Suzuki et al. | 84/719 |
| 2013/0180390 | A1 * | 7/2013 | Ishida | 84/745 |

FOREIGN PATENT DOCUMENTS

| | | |
|---|---|---|
| JP | 2550102 | 6/1997 |
| JP | 2002-116760 | 4/2002 |

* cited by examiner

*Primary Examiner* — Robert W Horn
(74) *Attorney, Agent, or Firm* — Christie, Parker & Hale, LLP

(57) ABSTRACT

A keyboard device for an electronic keyboard instrument, including several keys arranged side by side in a left-right direction, a hammer support disposed rearward of the keys, a plurality of hammers pivotally supported by the hammer support to be pivotally moved in accordance with key depression, and a key switch having a plurality of switch bodies provided in association with the respective hammers and a switch board mounted to the hammer support. The hammer support has a hammer supporting part for supporting the hammers and a switch mounting part to which the key switch is mounted, and is formed by an injection molded article of a predetermined kind of synthetic resin.

11 Claims, 6 Drawing Sheets

KEYBOARD DEVICE FOR ELECTRONIC KEYBOARD INSTRUMENT

CROSS-REFERENCE TO RELATED APPLICATION

This application claims priority to and the benefit of Japanese Patent Application Number 005033/2012, filed on Jan. 13, 2012, Japanese Patent Application Number 005034/2012, filed on Jan. 13, 2012, and Japanese Patent Application Number 005035/2012, filed on Jan. 13, 2012, the entire disclosures of which are incorporated herein by reference.

BACKGROUND OF THE INVENTION

1. Field of the Invention

The present invention relates to a keyboard device for an electronic keyboard instrument, such as an electronic piano.

2. Description of the Related Art

Conventionally, as a keyboard device for an electronic piano, there has been known one disclosed e.g. in Japanese Patent Laid-Open Publication No. 2002-116760 filed by the present applicant. The keyboard device comprises a plurality of swingable keys, a plurality of hammers provided in association with the respective keys for pivotal movement in accordance with key depression, and a hammer rail for pivotally supporting the hammers. Each of the hammers is formed into an arm-like shape extending in the front-rear direction of the keyboard device, and has a rear end thereof formed with a shaft hole having a C shape in side view and a lower surface thereof provided with an adjustment screw at a location immediately forward of the shaft hole. The hammer rail is formed by a single extrusion molded article of aluminum and extends in the left-right direction over the entire length of all the hammers.

The hammer rail has a hammer supporting part extending vertically, a stopper mounting portion extending obliquely forward and upward from the upper end of the hammer supporting part, and a fulcrum shaft portion projecting forward from the upper portion of the hammer supporting part, and these are formed into one piece. The stopper mounting portion has a front end thereof provided with a stopper for restricting the upward pivotal movement of each hammer and a key switch for detecting key depression information on each key. The key switch comprises a printed circuit board and a plurality of switch bodies attached to the printed circuit board in association with the respective keys. Each of the switch bodies is formed by a rubber switch having a plurality of movable contacts.

In the keyboard device configured as above, the shaft hole of each of the hammers is engaged with the associated fulcrum shaft portion of the hammer rail, whereby the hammer is pivotally supported by the hammer rail, with its adjustment screw placed on the rear end of the upper surface of the associated key. On the upper surface of each of the hammers, an actuator portion for pressing the associated switch body is formed at a location immediately forward of the shaft hole. In a key-released state, the actuator portion is opposed to the switch body with a slight gap. When the key is depressed in this state, the hammer is pushed up by the rear end of the key in accordance with the key depression to be pivotally moved upward about the fulcrum shaft portion. Then, the hammer comes into abutment with the stopper, whereby further pivotal movement of the hammer is stopped. During the pivotal movement of the hammer, the actuator portion of the hammer sequentially presses the movable contacts of the switch body, and a tone generated based on key depression information detected by the switch body is output from speakers of the electronic piano.

As another keyboard device for an electronic piano, there has been known one disclosed e.g. in Japanese Utility Model Registration Publication No. 2550102 filed by the present applicant. This keyboard device includes a keyboard chassis formed by two front and rear chassis (i.e. a front chassis and a rear chassis) each extending in the left-right direction of the keyboard device, and a plurality of metal reinforcement beams each extending in the front-rear direction and arranged in the left-right direction in a manner spaced from each other, so as to connect the two front and rear chassis, and a plurality of keys supported from below by the keyboard chassis and arranged side by side in the left-right direction.

A keyframe front and a keyframe center each extending in the left-right direction are rigidly secured to the respective front and rear portions of the front chassis of the keyboard chassis. On each of the keyframe front and the keyframe center, a plurality of front pins and balance pins are erected and arranged side by side in the left-right direction. Each of the keys has a front end thereof formed with a front pin hole open downward for engagement with the associated front pin, and a central portion thereof formed with a balance pin hole through which the associated balance pin is engaged. Thus, the key is supported on the keyframe center such that the key can swing about the balance pin in a state where the front pin prevents the key from swinging laterally.

In the keyboard device disclosed in Japanese Patent Laid-Open Publication No. 2002-116760, the pivotal speed, position, etc. of a hammer are determined according to the strength and depth of key depression by a player, and key depression information is detected based on the speed and amount of pressing of the switch body by the hammer. In order to detect the key depression information properly, it is required to set the positional relationship between the hammers and the key switch with high accuracy. Further, to fulfill this requirement, high dimensional accuracy is demanded of the hammer rail that supports the hammers and has the key switch mounted thereon.

However, in the above-described keyboard device, since the hammer rail is formed by an extrusion molded article of aluminum, the demanded high dimensional accuracy cannot be sufficiently obtained. More specifically, the hammer rail has its cross-section formed relatively accurately, but variation due to warpage or distortion can occur particularly in the fulcrum shaft portion having a small cross-section and extending long in the left-right direction. In this case, even if the variation is minute (e.g. 0.1 mm or so), proper relationship between the hammer engaged with the fulcrum shaft portion and the associated switch body of the key switch mounted to the stopper mounting portion may not be obtained. In this case, proper key depression information cannot be obtained, which makes it impossible to ensure proper tone generation.

In the case of the keyboard device configured as disclosed in Japanese Utility Model Registration Publication No. 2550102, when the length of a key is to be changed e.g. following a design change of an electronic piano, by achieving commonality of each of the front chassis, the rear chassis, the keyframe front, and the keyframe center, between before and after the design change, and then manufacturing the metal reinforcement beams for connecting the two chassis according to the length of the key, it is possible to suppress an increase in manufacturing costs due to the design change. However, in this keyboard device, the keyframe front and the keyframe center are rigidly secured to the front chassis, and hence the distance between the front pin hole and the balance pin hole of each key is determined depending on the distance between the keyframe front on which the front pins are erected and the keyframe center on which the balance pins are erected. For this reason, e.g. as to the length of a portion of the key extending forward from the swing fulcrum of the key, an allowable range of setting is limited within the dimension of the front chassis in the front-rear direction, and therefore the degree of freedom in designing the keyboard device is not large enough.

Further, the surroundings of the keyframe center rigidly secured to the front chassis is supported from below by the metal reinforcement beams, but between adjacent two of the metal reinforcement beams, the front chassis is spaced from the keybed on which the keyboard chassis is placed. For this reason, when an impact is applied to the keyboard device e.g. due to careless dropping of the electronic piano during transportation of the same, a portion of the front chassis between the adjacent metal reinforcement beams around the keyframe center can be warped downward, resulting in permanent deformation thereof. In this case, a key supported by the keyframe center at a location corresponding to the warpage is lowered in level with respect to the other keys, which makes the keys irregular in level. Further, when the key is depressed strongly, the keyframe center can be vibrated vertically. In this case, key touch feeling is degraded. Thus, the above-described keyboard device leaves room for improvement.

SUMMARY OF THE INVENTION

It is a first object of the present invention to provide a keyboard device for an electronic keyboard instrument, which makes it possible to set positional relationship between hammers and a key switch with high accuracy to thereby ensure proper detection of key depression information and excellent tone generation based on the properly detected key depression information.

It is a second object of the present invention to provide a keyboard device for an electronic keyboard instrument, which makes it possible to flexibly cope with changes e.g. in key length and position of a support for swinging movement of each key to thereby enhance the degree of freedom of design, as well as to hold a keyframe center in a stable state to thereby maintain uniformity in the level of a plurality of keys supported by the keyframe center and excellent key touch feeling.

To attain the above first object, in a first aspect of the present invention, there is provided a keyboard device for an electronic keyboard instrument, comprising a plurality of keys each extending in a front-rear direction and configured to be swingable about a support located at or close to a center thereof in the front-rear direction, the key being arranged side by side in a left-right direction, a hammer support disposed rearward of the keys, a plurality of hammers pivotally supported by the hammer support, each hammer being in abutment with a rear end of an associated one of the keys from above and configured to be pivotally moved in accordance with depression of the associated key, and a key switch including a plurality of switch bodies that are provided in association with the hammers, respectively, and a switch board that has the switch bodies attached thereto and is mounted to the hammer support, the key switch detecting key depression information on a key by having an associated one of the switch bodies pressed by an associated one of the hammers pivotally moved by depression of the key, wherein the hammer support includes a hammer supporting part for supporting the hammers, and a switch mounting part to which the key switch is mounted, and the hammer support is formed by an injection molded article made of a predetermined kind of synthetic resin.

With the arrangement of this keyboard device, the hammer support disposed rearward of the keys has the hammer supporting part for supporting the hammers each of which is pivotally moved in accordance with key depression, and a switch mounting part to which is mounted the key switch having the switch bodies each to be pressed by an associated one of the hammers. The hammer support is formed by an injection molded article made of a predetermined kind of synthetic resin, so that it is possible to ensure high dimensional accuracy. The positional relationship between the hammers and the key switch can be set with high accuracy by the hammer support having the above-mentioned high dimensional accuracy. This makes it possible to ensure proper detection of key depression information and proper tone generation based on the properly detected key depression information.

Preferably, the hammer support further comprises a plurality of fulcrum shaft portions that are arranged in a straight line along an axis extending horizontally in the left-right direction, and have the hammers engaged therewith, respectively, a stopper portion that restricts pivotal movement of one of the hammers which is being pivotally moved by depression of the associated key, by having the hammer abutted thereon, and a plurality of partition walls each formed in a manner partitioning adjacent two of the fulcrum shaft portions and configured to reinforce rigidity of the hammer support.

With the arrangement of this preferred embodiment, the fulcrum shaft portions of the hammer support are arranged in a straight line along the axis extending horizontally in the left-right direction, so that the hammers each engaged with an associated one of the fulcrum shaft portions can be positioned in a state uniformly aligned in the left-right direction. Further, when a hammer is pivotally moved in accordance with key depression, the hammer is brought into abutment with the stopper portion, whereby further pivotal movement of the hammer is restricted. At this time, load acts on the hammer support due to abutment of the hammer against the hammer support. Since the hammer support has the partition walls each formed in a manner partitioning adjacent two of the fulcrum shaft portions and the rigidity of the hammer support is reinforced by the partition walls, it is possible to obtain the hammer support having high rigidity which can sufficiently bear the load caused by the hammer and thereby stably support the pivotal movement of the hammer.

Preferably, the predetermined kind of synthetic resin is fiber-reinforced plastic.

With the construction of this preferred embodiment, since fiber-reinforced plastic is employed as a material for forming the hammer support, it is possible to further enhance the rigidity of the hammer support by rigid properties of the material itself. Further, since the rigidity of the hammer support can be enhanced by the material as mentioned above, it is possible to reduce the number of the partition walls to thereby achieve reduction of weight of the hammer support.

Preferably, the hammer support is provided in plurality, and the hammer supports each correspond to one octave at the maximum and are arranged side by side in the left-right direction.

With the arrangement of this preferred embodiment, the hammer support is provided in plurality, and each hammer support corresponds to one octave at the maximum. Therefore, the hammer support is more compact and lighter than a conventional long and heavy hammer rail of aluminum. Therefore, the hammer support can be handled with ease during manufacturing of the keyboard device, which makes it possible to achieve space reduction for storage. Further, when the number of keys of the keyboard device is to be changed e.g. due to a model change of an electronic keyboard instrument, it is possible to flexibly cope with the model change by using hammer supports corresponding in number to the keys.

More preferably, the keyboard device further comprises a plurality of metal connecting members that extend in the left-right direction over an entire length of the hammer supports and arranged in a manner spaced from each other, for connection of the hammer supports, and a metal reinforcing member that connects the connecting members and is grounded, the metal reinforcing member being provided for reinforcing rigidity of the hammer supports.

With the arrangement of this preferred embodiment, since the hammer supports are connected to each other by the metal connecting members extending in the left-right direction over the entire length of the hammer supports, it is possible not only to achieve secure connection of the hammer support parts, but also to reinforce the rigidity of the hammer supports. Further, the metal connecting members are connected by the metal reinforcing member, so that the rigidity of the hammer supports can be reinforced by the reinforcing member as well. In addition, since the reinforcing member is grounded, the connecting members connecting the hammer support parts are also grounded via the reinforcing member. Consequently, when a computer including a large number of electronic components is installed in the vicinity of the keyboard device within the electronic keyboard instrument, it is possible to prevent the connecting members functioning as antennas from radiating electromagnetic waves emitted from the electronic components of the computer out of the electronic keyboard instrument. As a consequence, it is possible to prevent influence of the electromagnetic waves upon electronic apparatuses and the like existing around the electronic keyboard instrument.

To attain the above first object, in a second aspect of the present invention, there is provided a keyboard device for an electronic keyboard instrument, comprising a keyboard chassis made of a metal, a keyframe center made of a synthetic resin which is mounted on the keyboard chassis in a manner extending in a left-right direction and has a plurality of balance pins erected in a manner arranged side by side in the left-right direction, a plurality of keys each extending in a front-rear direction, and engaged with an associated one of the balance pins via a balance pin hole formed at or near a center of the key in the front-rear direction, thereby being swingably supported on the keyframe center using the balance pin as a support, the keys being arranged side by side in the left-right direction, a hammer support connected to a rear end of the keyboard chassis, a plurality of hammers pivotally supported by the hammer support, each hammer being in abutment with a rear end of an associated one of the keys from above and configured to be pivotally moved in accordance with depression of the associated key, and a key switch including a plurality of switch bodies that are provided in association with the hammers, respectively, and a switch board that has the switch bodies attached thereto and is mounted to the hammer support, the key switch detecting key depression information on a key by having an associated one of the switch bodies pressed by an associated one of the hammers pivotally moved by depression of the key, wherein the hammer support includes a hammer supporting part for supporting the hammers, and a switch mounting part to which the key switch is mounted, and the hammer support is formed by an injection molded article made of a synthetic resin.

With the arrangement of this keyboard device, the keyframe center of a synthetic resin is mounted on the metal keyboard chassis, and the balance pin hole of each of the keys is engaged with an associated one of the balance pins erected on the keyframe center, whereby the keys are swingably supported on the keyframe center using the respective balance pins as supports. As described above, the keys are supported on the keyframe center mounted on the metal keyboard chassis relatively high in rigidity and shape retention, and the keyframe center is made of a synthetic resin having relatively high shape retention against aging and dryness or humidity. Therefore, it is possible to hold the keys uniform in level and posture more stably over a longer time period than in a case where a keyboard chassis and a keyframe center are made of wood.

Further, the hammer support connected to the rear end of the keyboard chassis has the hammer supporting part for supporting the hammers each of which is pivotally moved in accordance with key depression and a switch mounting part to which is mounted the key switch having the switch bodies each to be pressed by an associated one of the hammers which is being pivotally moved. The hammer support is formed by an injection molded article made of a synthetic resin, so that it is possible to ensure high dimensional accuracy. The positional relationship between the hammers and the key switch can be set with high accuracy by the hammer support having the above-mentioned high dimensional accuracy, which makes it possible to ensure proper detection of key depression information and proper tone generation based on the properly detected key depression information.

Preferably, the hammer support further comprises a plurality of fulcrum shaft portions that are arranged in a straight line along an axis extending horizontally in the left-right direction, and have the hammers engaged therewith, respectively, a stopper portion that restricts pivotal movement of one of the hammers which is being pivotally moved by depression of the associated key, by having the hammer abutted thereon, and a plurality of partition walls each formed in a manner partitioning adjacent two of the fulcrum shaft portions and configured to reinforce the hammer support.

With the arrangement of this preferred embodiment, the fulcrum shaft portions of the hammer support are arranged in a straight line along the axis extending horizontally in the left-right direction, so that the hammers each engaged with an associated one of the fulcrum shaft portions can be positioned in a state uniformly aligned in the left-right direction. Further, when a hammer is pivotally moved in accordance with key depression, the hammer is brought into abutment with the stopper portion, whereby further pivotal movement of the hammer is restricted. At this time, load acts on the hammer support due to abutment of the hammer against the hammer support. Since the hammer support has the partition walls each formed in a manner partitioning adjacent two of the fulcrum shaft portions and the rigidity of the hammer support is reinforced by the partition walls, it is possible to obtain the hammer support having high rigidity which can sufficiently bear the load caused by the hammer and thereby stably support the pivotal movement of the hammer.

More preferably, the keyboard chassis has a rear rail provided on a rear end thereof in a manner extending in the left-right direction, and the hammer support is connected to the rear rail with a first screw screwed in along an axis extending in a vertical direction and a second screw screwed in along an axis extending in a front-rear direction.

With the arrangement of this preferred embodiment, the hammer support is rigidly secured to the rear rail provided on the rear end of the keyboard chassis in a manner extending in the left-right direction, with the first and second screws screwed in in two directions different from each other. For example, in a case where the hammer support is rigidly secured to the rear rail with screws screwed in in a single direction, when load from the hammer acts on the hammer support, the hammer support can be warped about screwed portions. With the above-described arrangement of the preferred embodiment, however, since the hammer support is rigidly secured to the rear rail with the screws screwed in in the two different directions, it is possible to prevent the above-mentioned warpage to thereby stably restrict the pivotal movement of the hammer.

Further preferably, the keyboard chassis has a plurality of ribs each extending in the front-rear direction and arranged in a manner spaced from each other in the left-right direction, and the rear rail is connected to each of the ribs with a third screw screwed in along an axis extending in the vertical direction and a fourth screw screwed in along an axis extending in the front-rear direction.

With the configuration of this preferred embodiment, the rear rail is rigidly secured to the ribs of the keyboard chassis extending in the front-rear direction, with the third and fourth screws screwed in in two different directions. For example, in a case where the rear rail is rigidly secured to the ribs with screws screwed in in a single direction, when load from the hammer acts on the hammer support, the rear rail connected to the hammer support can be warped about a screwed portion. With the above-described arrangement of the preferred embodiment, however, since the rear rail is rigidly secured to the ribs with the screws screwed in in the two directions different from each other, it is possible to prevent the above-mentioned warpage to thereby stably restrict the pivotal movement of the hammer.

To attain the above second object, in a third aspect of the present invention, there is provided a keyboard device for an electronic keyboard instrument, comprising a keybed, a keyboard chassis having a front rail, a center rail, and a rear rail, each extending in a left-right direction and arranged in a manner spaced from each other in a front-rear direction, and a plurality of connecting members extending in the front-rear direction and arranged in a manner spaced from each other in the left-right direction, for connecting the front rail, the center rail, and the rear rail, the front rail, the rear rail, and the center rail being connected to the connecting members with the front rail and the rear rail placed on the keybed and the center rail placed on the connecting members, a keyframe center extending in a lengthwise direction of the center rail and mounted on the center rail in a state placed thereon, the keyframe center having a plurality of balance pins erected thereon in a manner arranged side by side in the lengthwise direction of the center rail, and a plurality of keys each extending in a front-rear direction, and engaged with an associated one of the balance pins via a balance pin hole formed therethrough at a predetermined location in the front-rear direction, thereby being swingably supported on the keyframe center using the balance pin as a support, the keys being arranged side by side in the left-right direction.

With the arrangement of this keyboard device, the keyboard chassis is formed by connecting the front rail, the center rail, and the rear rail, each extending in the left-right direction, using the connecting members extending in the front-rear direction. The keyframe center extending in the lengthwise direction of the center rail is mounted on the center rail in a state placed thereon, and the balance pins are erected on the keyframe center in a manner arranged side by side in the lengthwise direction of the center rail. The keys arranged side by side in the left-right direction are each engaged with an associated one of the balance pins via the balance pin hole to be swingably supported on the keyframe center.

In a case where the length of the key of the keyboard device arranged as above is to be changed following a design change, such as a model change, of the electronic keyboard instrument, by achieving commonality of each of the front rail, the center rail, the rear rail, and the keyframe center, between before or after the design change, and then manufacturing the connecting members according to the length of the key, it is possible to suppress an increase in manufacturing costs after the design change. Further, since the front, center, and rear rails are independent of each other, it is possible not only to freely set spaces between the rails in the front-rear direction, but also to freely position the keyframe center mounted on the center rail between the front rail and the rear rail. Therefore, according to this aspect of the present invention, it is possible to flexibly cope with changes in the key length and the position of the key pivot and enhance the degree of freedom of design.

Preferably, the center rail includes a keyframe center-mounting portion extending in the lengthwise direction of the center rail, having the keyframe center mounted thereon, and connected to the connecting members in a state placed thereon, and a leg portion extending in the lengthwise direction of the center rail between adjacent ones of the connecting members, extending downward from the keyframe center-mounting portion, being configured to be in abutment with the keybed, so as to reinforce rigidity of the keyframe center-mounting portion.

With the arrangement of this preferred embodiment, the keyframe center is placed on the keyframe center-mounting portion connected to the connecting members in a state placed on the connecting members, and the leg portion extending downward from the keyframe center-mounting portion is held in abutment with the keybed. This leg portion makes it possible not only to reinforce the rigidity of the keyframe center-mounting portion, but also to stably hold the keyframe center placed on the keyframe center-mounting portion, while maintaining a fixed space between the keyframe center and the keybed. This makes it possible to maintain uniformity in level of the keys supported on the keyframe center and excellent touch feeling.

The above and other objects, features, and advantages of the present invention will become more apparent from the following detailed description taken in conjunction with the accompanying drawings.

BRIEF DESCRIPTION OF THE DRAWINGS

FIGS. 4A and 4B are perspective views of a hammer support, in which FIG. 4A shows a whole one-octave hammer support, and FIG. 4B shows the hammer support in a state partially cut away view;

FIGS. 5A and 5B are views of the hammer support, in which FIG. 5A shows the hammer support in plan view, and FIG. 5B shows the hammer support in front view;

DETAILED DESCRIPTION OF PREFERRED EMBODIMENTS

Figure 1:
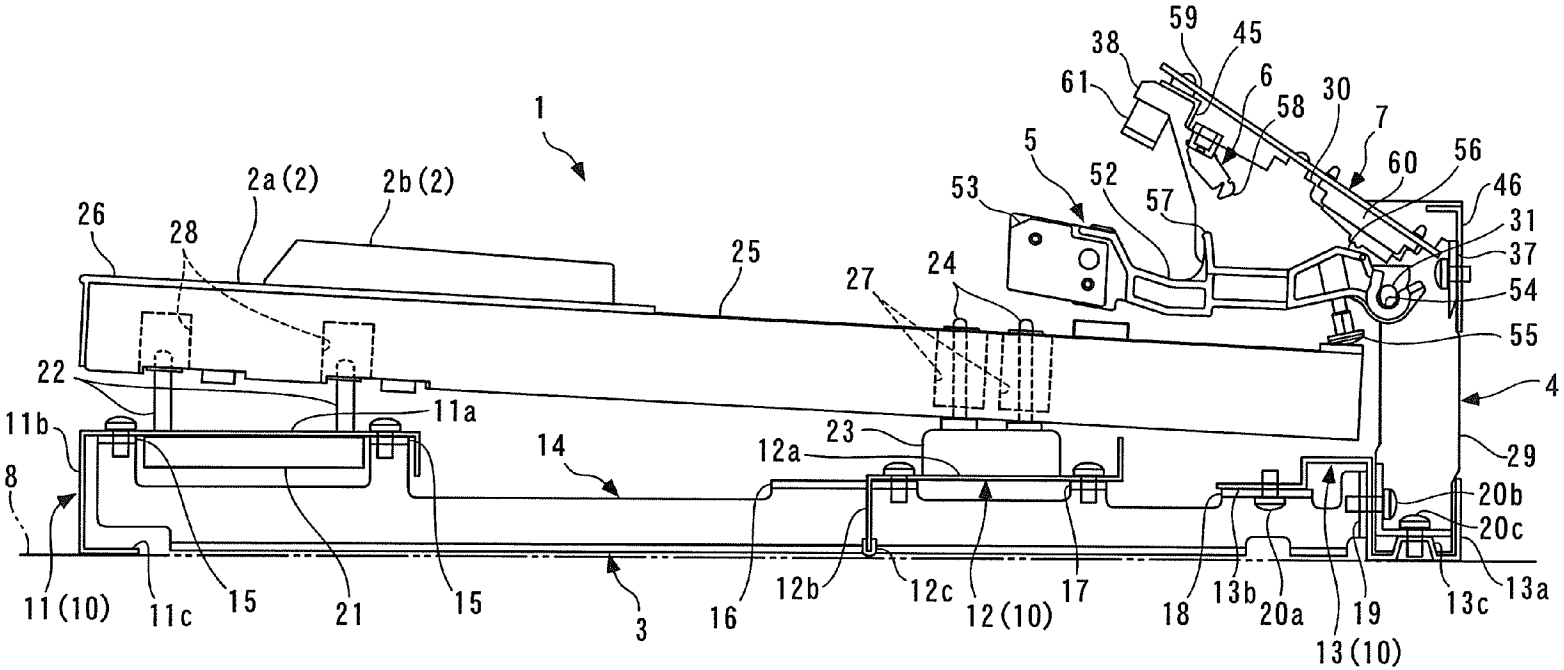
FIG. 1 is a side view, partially cut away, of a keyboard device for an electronic piano, according to an embodiment of the present invention.

The present invention will now be described in detail with reference to the drawings showing a preferred embodiment thereof. FIG. 1 shows a keyboard device for an electronic piano in a key-released state, according to the embodiment of the present invention.

As shown in FIG. 1, the keyboard device 1 includes a plurality of keys 2 (only one of white keys 2*a* and one of black keys 2*b* are shown) arranged side by side in the left-right direction (front-rear direction as viewed in FIG. 1) of the electronic piano, a keyboard chassis 3 for supporting the keys 2, hammer supports 4 connected to the rear end (right end as viewed in FIG. 1) of the keyboard chassis 3, a plurality of hammers 5 (only one of which is shown) each provided for an associated one of the keys 2, for pivotal movement in accordance with depression of the key 2, a plurality of let-off members 6 (only one of which is shown) each provided for an associated one of the hammers 5 so as to add a let-off feeling to the touch feeling of the associated key 2 when the key 2 is depressed, and a key switch 7 for detecting key depression information on the keys 2.

Figure 2:
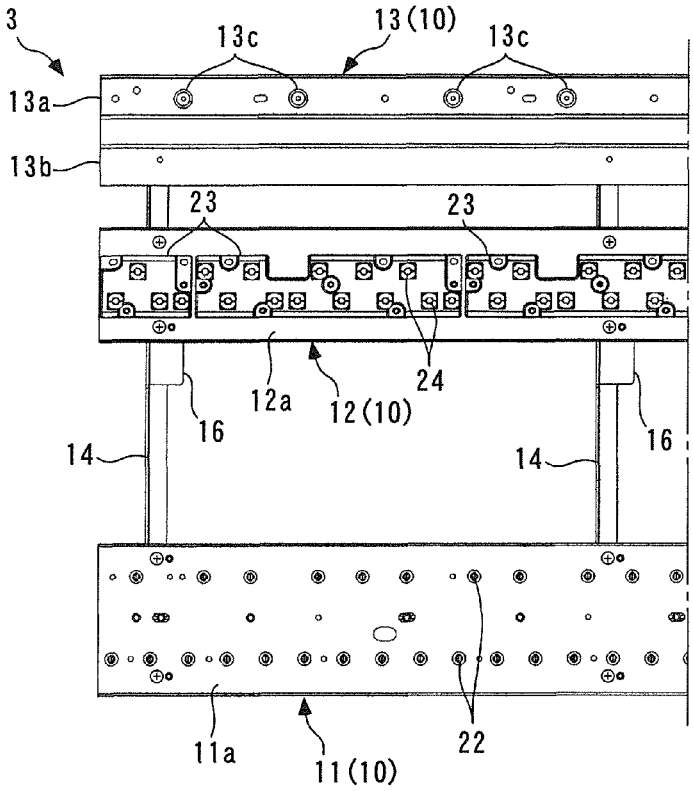
FIG. 2 is a plan view, partially cut away, of a keyboard chassis.

As shown in FIGS. 1 and 2, the keyboard chassis 3 is formed by assembling three support rails 10, i.e. a front rail 11, a center rail 12, and a rear rail 13 each extending in the left-right direction and arranged in the front-rear direction (the left-right direction as viewed in FIG. 1 and the vertical direction as viewed in FIG. 2) with a predetermined space therebetween, and a plurality of (e.g. five) reinforcement ribs 14 (only one of which is shown in FIG. 1 and only two of which are shown in FIG. 2) extending in the front-rear direction and arranged in the left-right direction with a predetermined space therebetween, in parallel crosses. The keyboard chassis 3 is rigidly secured on a keybed 8. Each of the support rails 10 and the ribs 14 is formed by an iron plate press-punched and bent into a predetermined shape, and they are connected to each other with screws. The support rail 10 is formed to have a smaller thickness (e.g. 1.0 mm) for reduction of weight, whereas the rib 14 is formed to have a larger thickness (e.g. 1.6 mm) for reinforcement.

As shown in FIG. 1, the front rail 11 has a horizontal top plate portion 11*a*, a front plate portion 11*b* bent downward at right angles from the front end of the top plate portion 11*a*, and a bottom plate portion 11*c* bent rearward at right angles from the lower end of the front plate portion 11*b*. Note that that the top plate portion 11*a* has a rear end thereof bent downward at right angles, and the bottom plate portion 11*c* is formed to have a shorter dimension in the front-rear direction than that of the top plate portion 11*a*.

A keyframe front 21 is rigidly secured to the lower surface of the top plate portion 11*a* e.g. with screws. The keyframe front 21 is formed by a thick flat plate member of a predetermined kind of synthetic resin (e.g. polyethylene) and extends in the left-right direction over the entire length of the front rail 11. On the keyframe front 21, a plurality of front pins 22 are erected at respective front and rear locations corresponding to the white keys 2*a* and the black keys 2*b*, respectively, in a manner extending through the top plate portion 11*a* of the front rail 11 and arranged side by side in the left-right direction. Note that that the keyframe front 21 is formed by connecting a plurality of injection molded articles to each other in the left-right direction.

The center rail 12 has a horizontal keyframe center-mounting portion 12*a* and a leg portion 12*b* bent at right angles from the front end of the keyframe center-mounting portion 12*a* and extending downward by a predetermined length. Note that that the keyframe center-mounting portion 12*a* has a rear end thereof bent upward at right angles.

A keyframe center 23 is rigidly secured to the keyframe center-mounting portion 12*a* e.g. with screws. The keyframe center 23 is formed by a thick flat plate member of a predetermined kind of synthetic resin (e.g. polyethylene) and extends in the left-right direction over the entire length of the center rail 12. On the keyframe center 23, a plurality of balance pins 24 are erected at respective front and rear locations corresponding to the white keys 2*a* and the black keys 2*b*, respectively, in a manner arranged side by side in the left-right direction. Note that the keyframe center 23 is formed by a plurality of injection molded articles each corresponding to one octave at the maximum and arranged close to each other in the left-right direction as shown in FIG. 2.

As shown in FIG. 1, the leg portion 12*b* is held in abutment with the keybed 8 via a cushion 12*c* attached to the lower end of the leg portion 12*b*. Further, the leg portion 12*b* has downwardly open recessed portions (not shown) formed at locations corresponding to the respective ribs 14 so as to avoid interference with any of the ribs 14. In other words, the leg portion 12*b* extends in the left-right direction between the ribs 14 and 14 adjacent to each other, with its entire lower end held in abutment with the keybed 8.

The rear rail 13 has an accommodation recess 13*a* which opens upward and is engaged with the lower end of each hammer support 4 in a state accommodating the same, and a connecting portion 13*b* extending forward from the front upper end of the accommodation recess 13*a*. The accommodation recess 13*a* has screw holes formed through a front plate portion thereof in the front-rear direction, and a front wall portion 35 of the hammer support 4 is rigidly secured to the front plate portion of the accommodation recess 13*a* with screws. The accommodation recess 13*a* has a plurality of engaging protrusions 13*c* (only one of which is shown in FIG. 1, and four of which are shown in FIG. 2) formed on a bottom portion thereof at respective predetermined locations in the lengthwise direction of the rear rail 13, for engagement with a bottom wall portion 36 of the hammer support 4. Each of the engaging protrusions 13*c* is formed vertically therethrough with a screw hole, and the bottom wall portion 36 of the hammer support 4 is rigidly secured to the engaging protrusions 13*c* with screws 20*c* (first screw) screwed in along a vertically extending axis. Further, the accommodation recess 13*a* and the connecting portion 13*b* are rigidly secured to the rear ends of the respective ribs 14, as described hereinafter.

Figure 3:
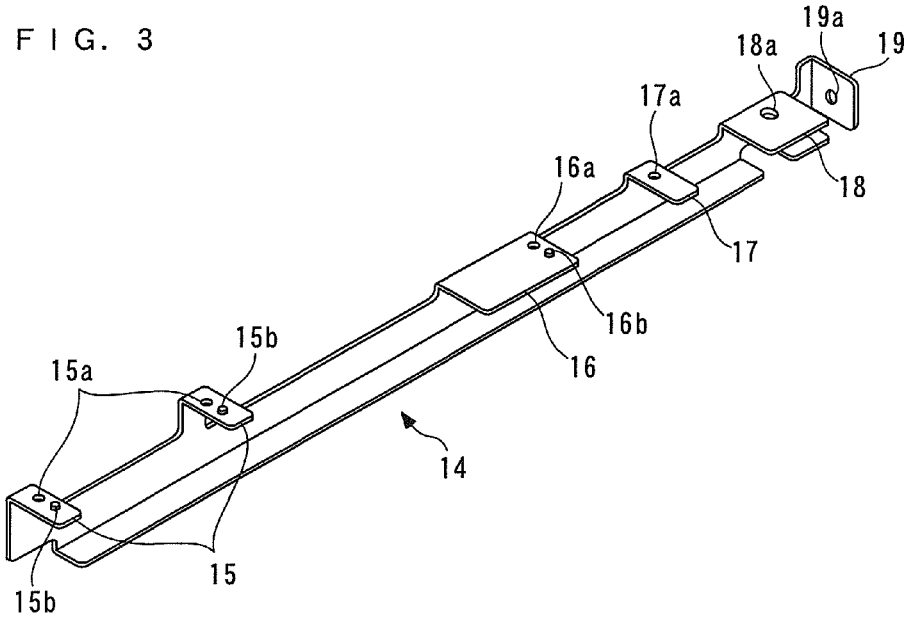
FIG. 3 is a perspective view of a rib.
Figure 4A:
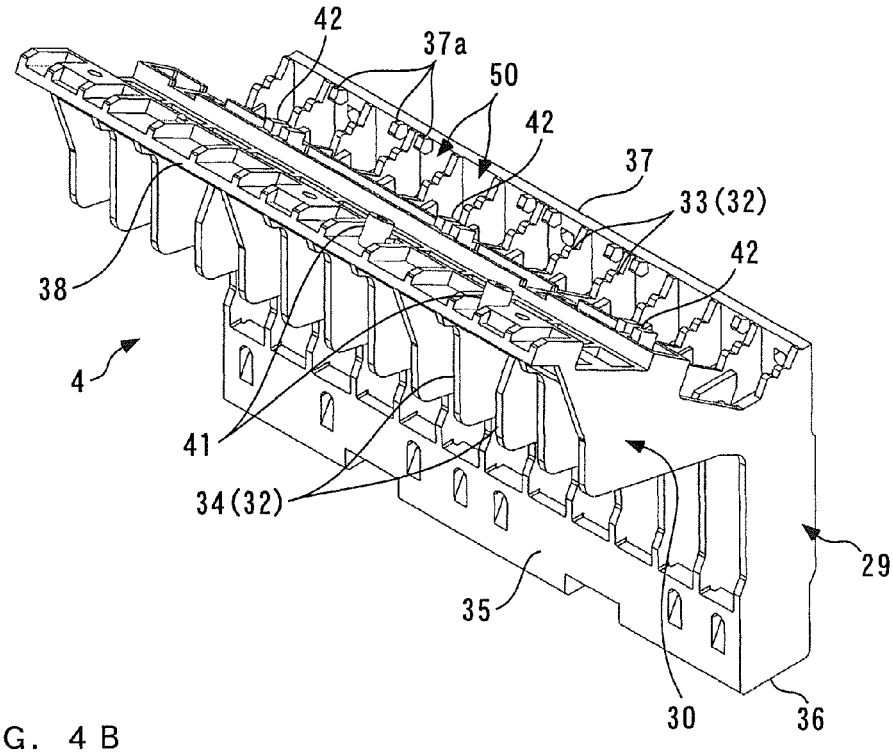
Figure 4B:
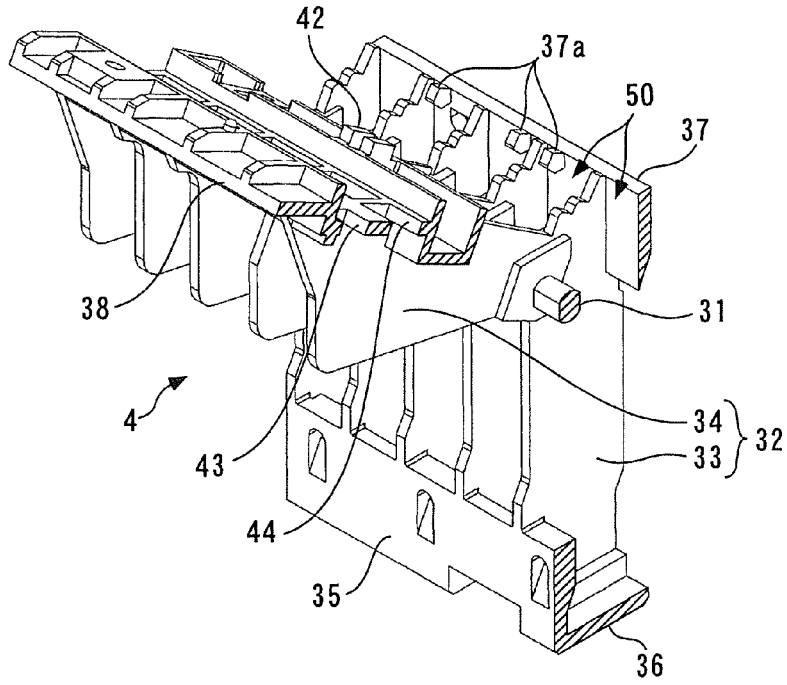
Figure 5A:
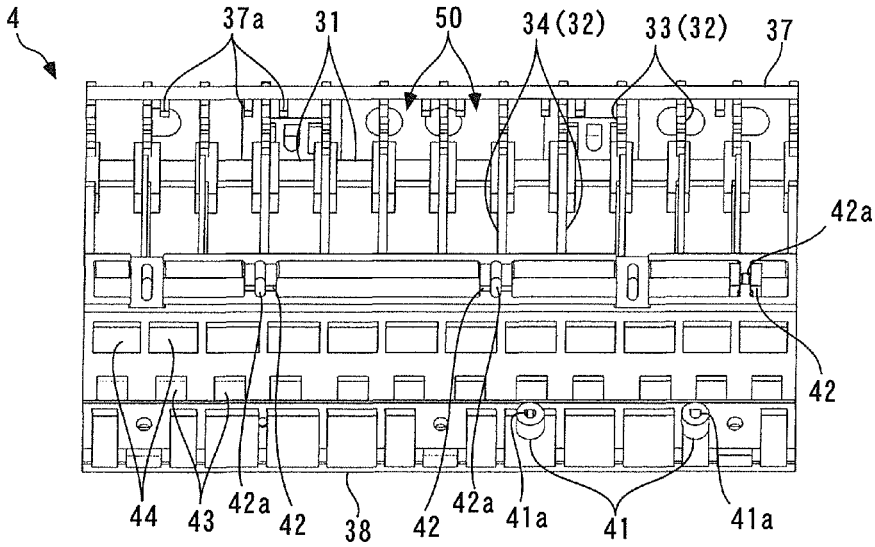
Figure 5B:
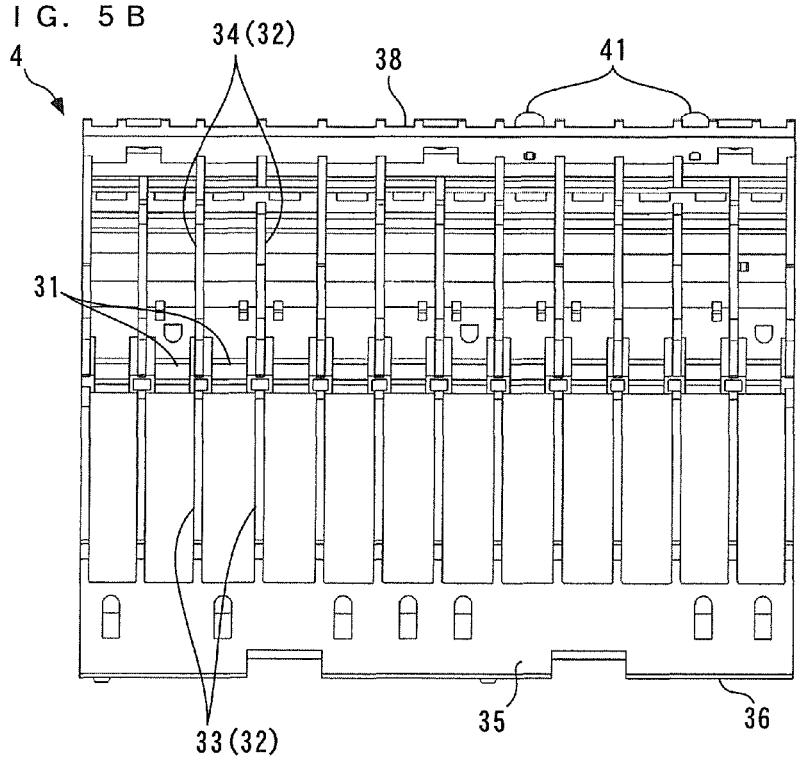

As shown in FIG. 3, each of the ribs 14 extends over a predetermined length in the front-rear direction, and has an L-shaped cross-section. The front end of the rib 14 is provided with a pair of front and rear bent portions 15 and 15 each bent rightward at right angles in a manner associated with the front rail 11, and each of the bent portions 15 and 15 has a screw hole 15*a* formed at a predetermined location. Further, the central portion of the rib 14 is provided with two front and rear bent portions 16 and 17 each bent rightward at right angles in a manner associated with the center rail 12, and the bent portions 16 and 17 have screw holes 16*a* and 17*a*, respectively, formed at respective predetermined locations. Furthermore, the rear end of the rib 14 is provided with bent portions 18 and 19 each bent rightward at right angles in a manner associated with the rear rail 13, and the bent portions 18 and 19 have screw holes 18*a* and 19*a* formed at respective predetermined locations. Differently from the bent portions 15 to 18, the bent portion 19 formed at the rear end of the rib 14 is bent about a vertical axis.

Further, the front and central bent portions 15 and 16 of the rib 14 have protrusions 15*b* and 16*b* formed thereon by half punching which protrude slightly upward in the vicinity of the respective screw holes 15*a* and 16*a*. The protrusions 15*b* and 16*b* are brought into engagement with respective holes formed at respective locations in the front rail 11 and the center rail 12 when connecting the front and center rails 11 and 12 and the rib 14. This not only facilitates positioning of the front rail 11 and the center rail 12 and the rib 14, but also makes it possible to prevent the rib 14 from turning with respect to the front rail 11 or the center rail 12 and effectively connect them.

The rear rail 13 is rigidly secured to the bent portions 18 and 19 of the rear end of the rib 14 with screws. More specifically, as shown in FIG. 1, the connecting portion 13*b* of the rear rail 13 is rigidly secured to the bent portion 18 in a state vertically overlaid manner, with screws 20*a* (third screw) each screwed in along a vertical extending axis. Further, the front plate portion of the accommodation recess 13*a* of the rear rail 13 is rigidly secured to the bent portion 19 in a manner overlaid in the front-rear direction, together with the front wall portion 35 of the lower portion of the hammer support 4, with screws 20*b* (second screw, fourth screw) each screwed in along an axis extending in the front-rear direction.

As described above, the rear rail 13 is rigidly secured to the rib 14 with the screws screwed in in two different directions, i.e. the vertical direction and the front-rear direction, respectively. For example, in a case where the rear rail 13 is rigidly secured to the rib 14 with screws screwed in in a single direction, when the hammer 5 performing pivotal movement comes into abutment with a hammer stopper 61 to cause load to act, the rear rail 13 can be warped about a screwed portion, as described hereinafter. For this reason, the rear rail 13 is rigidly secured to the rib 14 with the screws screwed in in the two directions different from each other, whereby it is possible to prevent the above-mentioned warpage to thereby stably restrict the pivotal movement of the hammer 5.

Each of the keys 2 comprises a wooden key body 25 extending in the front-rear direction and having a rectangular cross-section and a key cover 26 made of a synthetic resin and bonded to the top and front surfaces of a front half of the key body 25. A portion of the key body 25 rearward of the center of the key body 25 in the front-rear direction is formed with a balance pin hole 27 in which the balance pin 24 is engaged in a state inserted therethrough, and the key 2 is supported on the keyframe center 23 in a manner swingable about the balance pin 24 as a support. Further, the front end of the key body 25 is formed with a front pin hole 28, and engagement between the front pin hole 28 and the front pin 22 prevents the key 2 from laterally swinging during a swing of the key 2.

The hammer supports 4 are a plurality of injection molded articles each made of a predetermined kind of synthetic resin (e.g. ABS resin), and the molded articles, each corresponding to one octave at the maximum, forming the hammer supports 4 are connecting to each other, and extend over the entire length of all the hammers 5 in the left-right direction. As shown in FIG. 1, each hammer support 4 includes a hammer supporting part 29 erected from the rear rail 13 and a switch mounting part 30 extending forward and obliquely upward from the upper end of the hammer supporting part 29. The upper end of the hammer supporting part 29 is formed with horizontal pin-shaped fulcrum shaft portions 31 for supporting the respective hammers 5.

FIGS. 4A and 4B and 5A and 5B show the hammer support 4 corresponding to one-octave. As shown in FIGS. 4A and 4B and 5A and 5B, the hammer support 4 has a plurality of partition walls 32 each for separating hammers 5 adjacent to each other in the left-right direction with a predetermined space therebetween. Each of the partition walls 32 comprises a square wall 33 formed into a vertically elongated and roughly rectangular shape in side view, which corresponds to the hammer supporting part 29, and a triangular wall 34 formed into a roughly triangular shape in side view and continuous with the upper front end of the square wall 33, which corresponds to the switch mounting part 30. In the hammer support 4, all the square walls 33 have the front ends and lower ends of the lower portions thereof and the rear ends of the upper portions thereof make continuous with each other in the left-right direction via the front wall portion 35, the bottom wall portion 36, and a rear wall portion 37. On the other hand, all the triangular walls 34 have the front half portions of the upper portions thereof made continuous with each other in the left-right direction via an upper wall portion 38.

As described hereinbefore, the front wall portion 35 is rigidly secured to the front plate portion of the accommodation recess 13*a* of the rear rail 13 with screws. Further, the bottom wall portion 36 is rigidly secured to the accommodation recess 13*a* of the rear rail 13 with screws via the engaging protrusions 13*c*. The hammer support 4 is rigidly secured to the rear rail 13 with screws screwed in in the vertical direction and the front-rear direction, i.e. in two directions different from each other. For example, in a case where the hammer support 4 is rigidly secured to the rear rail 13 with screws screwed in in a single direction, when the hammer 5 comes into abutment with the hummer stopper 61 to cause load to act, the hammer support 4 can be warped about screwed portions, as described hereinafter. For this reason, the hammer support 4 is rigidly secured to the rear rail 13 with the screws screwed in in the two different directions, whereby it is possible to prevent the above-mentioned warpage to thereby stably restrict the pivotal movement of the hammer 5.

On the upper end of the front surface of the rear wall portion 37, a plurality of board engaging parts 37*a* protruding obliquely upward and forward from the rear wall portion 37 are formed close to the upper ends of the square walls 33 as appropriate. The rear end of a switch board 59, described hereinafter, of the key switch 7 is latched between the board engaging parts 37*a* and the square walls 33 in an inserted state.

The upper wall portion 38 has an upper-surface front end thereof formed with a plurality of screwing parts 41 each having a screw hole 41*a* and protruding upward by a predetermined length, and an upper-surface rear end thereof formed with a plurality of board supporting parts 42 each protruding upward by a predetermined length. Each of the board supporting parts 42 comprises a pair of protrusions arranged in the left-right direction with a slight space therebetween, and a screw hole 42*a* formed between the two protrusions. Further, the upper wall portion 38 has a plurality of mounting holes 43 each formed between associated adjacent partition walls 32 and 32 (triangular walls 34 and 34), for use in mounting the associated let-off member 6. Note that that an opening 44 formed in the upper wall portion 38 at a location rearward of the associated mounting hole 43 is used to prevent an engaging protrusion 57, described hereinafter, of the hammer 5 for engagement with the let-off member 6 from abutting on the upper wall portion 38 when the hammer 5 is pivotally moved upward.

Between each adjacent two of the partition walls 32 and 32, the fulcrum shaft portion 31 extends in the left-right direction in a manner connecting between portions of the respective adjacent partition walls 32 and 32 where the square wall 33 and the triangular wall 34 meet. The fulcrum shaft portions 31 are arranged in a straight line along an axis extending horizontally in the left-right direction, and each of the hammers 5 is pivotally supported by an associated one of the fulcrum shaft portions 31.

The hammer supports 4 constructed as above are arranged in a manner adjacent to each other in the left-right direction, and are connected to each other via two metal connection boards 45 and 46 (connection members) extending over the entire length of the hammer supports 4 in the left-right direction. Specifically, each of the connection boards 45 and 46 has an L-shaped cross-section, and the upper wall portions 38 of the respective hammer supports 4 are connected by the connection board 45 e.g. with screws, while the rear wall portions 37 of the respective hammer supports 4 are connected by the connection board 46 e.g. with screws.

As shown in FIG. 1, each of the hammers 5 comprises an arm-like hammer body 52 extending in the front-rear direction and weight plates 53 (only one of which is shown) attached to the respective left and right sides of the front end of the hammer body 52. The hammer body 52 is made of a synthetic resin, while the weight plates 53 are each made of a metal material, such as a ferrous material, having a relatively high specific gravity. The hammer body 52 has a rear end thereof formed with an arcuate shaft hole 54, and the shaft hole 54 is engaged with the fulcrum shaft portion 31, whereby the hammer 5 is pivotally supported by the hammer support 4.

A capstan screw 55 is screwed into the lower surface of the hammer body 52 at a location immediately forward of the shaft hole 54 such that the capstan screw 55 can be screwed in and out. The hammer 5 is placed on the rear end of the associated key 2 via the capstan screw 55. A portion of the upper surface of the hammer body 52 between the shaft hole 54 and the capstan screw 55 functions as an actuator portion 56 for causing the key switch 7 to operate during key depression. Further, on a central portion of the upper surface of the hammer body 52 in the front-rear direction, there is formed the plate-like engaging protrusion 57 that is brought into engagement with the let-off member 6 during key depression.

Each of the let-off members 6 is formed by a molded article of a predetermined elastic material (e.g. styrene-based thermoplastic elastomer), and is mounted to the switch mounting part 30 of the hammer support 4. The let-off member 6 extends obliquely rearward and downward from the switch mounting part 30, and has a front end thereof formed as a head part 58 protruding from a neck part. In a key-released state, the head part 58 is opposed to the engaging protrusion 57 of the hammer 5.

The key switch 7 comprises the switch board 59 implemented by a printed circuit board and a plurality of switch bodies 60 (only one of which is shown) each formed by a rubber switch and attached to the lower surface of the switch board 59 in association with the respective keys 2. Note that that the switch board 59 has a plurality of fixed contacts (not shown) provided in association with each of the switch bodies 60, and each of the switch bodies 60 has a plurality of movable contacts (not shown) for connecting between the fixed contacts.

Further, on the lower surface of the front end of the upper wall portion 38 of the hammer support 4, there is provided the hammer stopper 61 (stopper portion) made e.g. of foamed urethane. An upward pivotal movement of the hammer 5 is restricted by the hammer stopper 61.

Figure 6:
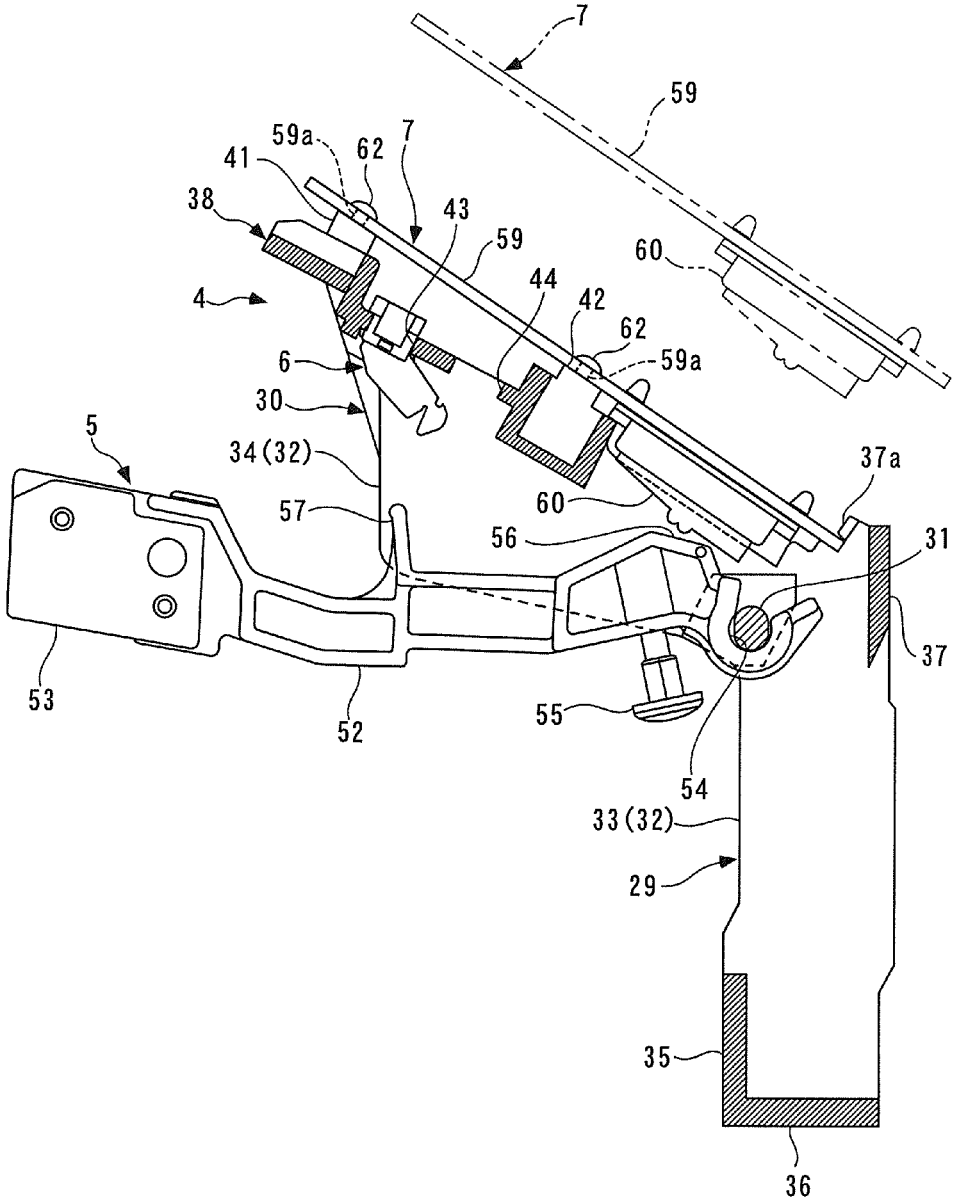
FIG. 6 is a side cross-sectional view of the hammer support having a hammer, a let-off member, and a key switch mounted thereon, together with the key switch removed from the hammer support.

FIG. 6 shows the hammer support 4 having the hammer 5, the let-off member 6, and the key switch 7 mounted thereon, together with the key switch 7 removed from the hammer support 4 on an enlarged scale. As shown in FIG. 6, the key switch 7 is mounted to the hammer support 4 in a state placed on the upper surface of the switch mounting part 30.

Specifically, the switch board 59 of the key switch 7 has a rear end (right end as viewed in FIG. 6) thereof latched between the board engaging parts 37*a* of the rear wall portion 37 and the square walls 33 in an inserted state, a central portion thereof placed on the board supporting parts 42 of the upper wall portion 38, and a front end thereof placed on the screwing parts 41 of the upper wall portion 38, as described hereinbefore. The front end of the switch board 59 and the central portion of the same are formed with mounting holes 59*a* and 59*a* at respective locations corresponding to the screw holes 41*a* and 42*a* of the hammer support 4, and screws 62 are screwed from above into the screw holes 41*a* of the screwing parts 41 and the screw holes 42*a* of the board supporting parts 42 via the respective mounting holes 59*a*. Further, each of the switch bodies 60 of the key switch 7 faces toward the actuator portion 56 of the associated hammer 5 from above via an opening 50 (see FIGS. 4A, 4B and 5A) defined by associated partition walls 32 and 32 on the opposite sides of the hammer 5, the rear wall portion 37, and the upper wall portion 38 in a manner extending vertically through the hammer support 4, and is opposed to the actuator portion 56 via a slight gap.

Figure 7:
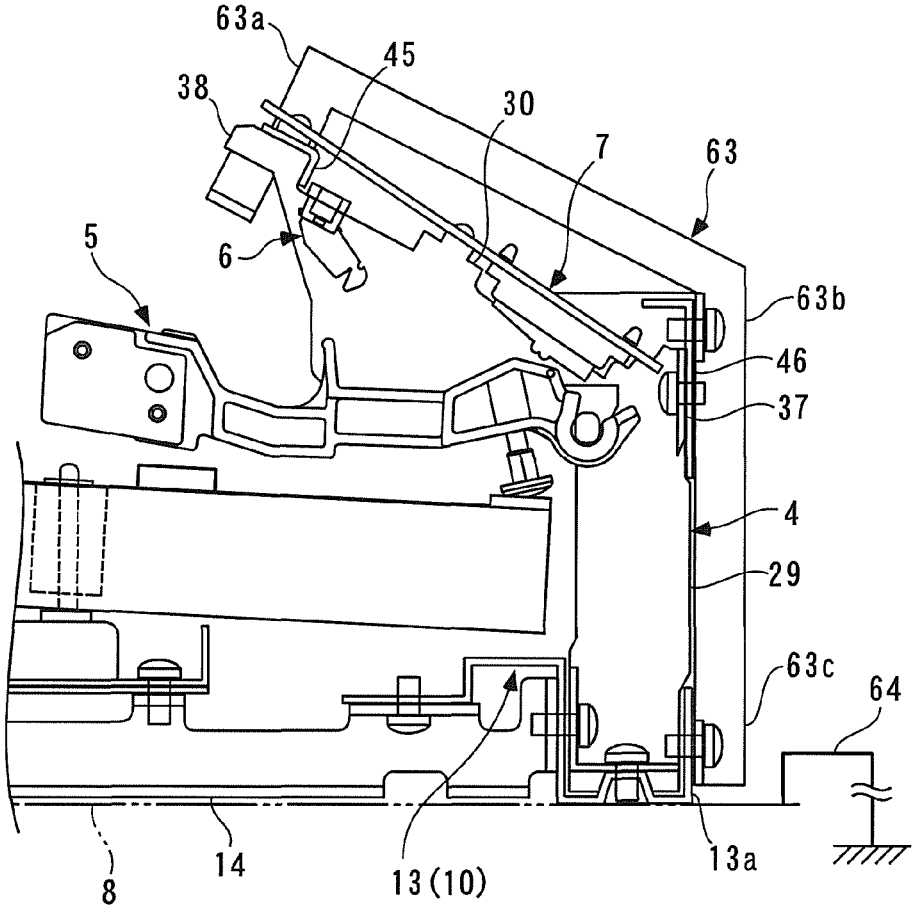
FIG. 7 is a side view showing a state where connection boards connecting hammer supports to each other are connected by reinforcing members.

Further, as shown in FIG. 7, a plurality of metal reinforcing members 63 (only one of which is shown) may be provided outside the hammer supports 4 so as to reinforce the rigidity of the hammer supports 4. Each of the reinforcing members 63 is formed by press blanking and bending an iron plate into a predetermined shape such that the reinforcing member 63 extends substantially along the outer surface of the hammer supporting part 29 of the hammer support 4 and that of the switch mounting part 30. The reinforcing members 63 are disposed e.g. at the left and right opposite ends of the hammer supports 4 connected in the left-right direction. Note that that it is also possible to arrange additional reinforcing members 63 between the two reinforcing members 63 and 63, as required.

An upper end 63*a* of the reinforcing member 63 is rigidly secured to the upper wall portion 38 of the hammer support 4 with screws together with the connection board 45 in a state in abutment with the same. A central portion 63*b* of the reinforcing member 63 is rigidly secured to the rear wall portion 37 of the hammer support 4 with screws together with the connection board 46 in a state in abutment with the same. A lower end 63*c* of the reinforcing member 63 is rigidly secured to the accommodation recess 13*a* of the rear rail 13.

Thus, it is possible not only to rigidly connect the hammer supports 4 by the two connection boards 45 and 46, but also to reinforce the rigidity of the hammer supports 4. Further, the rigidity of the hammer supports 4 can be reinforced by the reinforcing members 63 as well. Furthermore, the reinforcement of the hammer supports 4 by the connection boards 45 and 46 and the reinforcing members 63 makes it possible to prevent occurrence of a trouble due to thermal deformation of the hammer support 4 made of a synthetic resin even when an electronic piano is left for a long time in an automotive vehicle under a burning sun, with the keyboard device 1 standing upright, e.g. during transportation of the electronic piano.

Further, each of the reinforcing members 63 is grounded in the following manner: The keybed 8 has conductive paper (not shown) of aluminum foil or the like affixed on the entire surface thereof, and the keyboard chassis 3 is placed on the conductive paper which is grounded via a conductive wire 64.

Therefore, each of the reinforcing members 63 is grounded via the rear rail 13 of the keyboard chassis 3 and the conductive paper, and the two metal connection boards 45 and 46 connecting the hammer supports 4 are also grounded via the reinforcing members 63.

As a consequence, when a computer (not shown) including a large number of electronic components is installed in the vicinity of the keyboard device 1 within the electronic piano, it is possible to prevent the connection boards 45 and 46 functioning as antennas from radiating electromagnetic waves emitted from the electronic components of the computer out of the electronic piano. As a consequence, it is possible to prevent influence of the electromagnetic waves upon electronic apparatuses and the like existing around the electronic piano.

Next, a description will be given of the operation of the keyboard device 1 configured as above. When depressed in the key-released state shown in FIG. 1, the key 2 pivotally moves about the balance pin 24 in the counterclockwise direction as viewed in FIG. 1, and in accordance with this pivotal movement of the key 2, the hammer 5 is pushed up via the capstan screw 55 to be pivotally moved upward (clockwise as viewed in FIG. 1) about the fulcrum shaft portion 31.

During the pivotal movement of the hammer 5, the engaging protrusion 57 is brought into engagement with the head part 58 of the let-off member 6 to press the let-off member 6 while compressing the same via the head part 58, whereby reaction force acting on the hammer 5 from the let-off member 6 is increased. When the hammer 5 is further pivotally moved, the engaging protrusion 57 is disengaged from the head part 58, whereby the reaction force from the let-off member 6 vanishes immediately. The increase and vanishment of the reaction force from the let-off member 6 provides let-off feeling closely similar to let-off feeling provided by an acoustic piano.

Then, the abutment of the hammer 5 with the hammer stopper 61 terminates the upward pivotal movement of the hammer 5. During the upward pivotal movement of the hammer 5, the actuator portion 56 presses the switch body 60 of the key switch 7 to thereby turn on the key switch 7, whereby key depression information on the key 2 corresponding to an amount of pivotal movement of the hammer 5 is detected and output to a tone generation controller (not shown). The tone generation controller controls the tone generation of the electronic piano based on the detected key depression information.

Thereafter, when the key 2 is released, the key 2 performs pivotal movement in a direction reverse to the direction in which the key 2 is pivotally moved when depressed, and returns to the key-released state shown in FIG. 1. As the key 2 returns to the key-released state, the hammer 5 also pivotally moves downward and returns to its key-released state.

As described in detail hereinabove, according to the keyboard device 1 of the present embodiment, the keys 2 are supported on the keyframe center 23 mounted on the metal keyboard chassis 3 excellent in rigidity and shape retention, and the keyframe center 23 is made of a synthetic resin having a high shape retention against aging and dryness or humidity. Therefore, it is possible to hold the keys 2 uniform in level and posture more stably over a longer time period than in a case where a keyboard chassis and a keyframe center are made of wood.

Further, the hammer support 4 for supporting the hammers 5 is formed by injection molded articles of a synthetic resin, so that it is possible to form the hammer support 4 with high dimensional accuracy. The positional relationship between the hammers 5 and the key switch 7 can be set with high accuracy using the hammer supports 4 having the above-mentioned high dimensional accuracy, and therefore it is possible to detect key depression information properly and ensure proper tone generation based on the detected key depression information. Further, since the fulcrum shaft portions 31 of the hammer support 4 are arranged in a straight line along the axis extending horizontally in the left-right direction, it is possible to dispose the hammers 5 in an arrangement uniform in the left-right direction. Furthermore, the partition walls 32 each formed between adjacent two of the fulcrum shaft portions 31 and 31 ensure high rigidity of the hammer supports 4, so that the hammer support 4 can support the hammers 5 such that each of the hammers 5 can perform stable pivotal movement.

In addition, since the entire hammer support assembly of the keyboard device 1 is formed by the hammer supports 4 each corresponding to one octave at the maximum, it is easier to handle the hammer support during manufacturing of the keyboard device 1 than in a conventional case where a keyboard device has a single long and heavy hammer rail of aluminum, which makes it possible to achieve space reduction for storage. Further, when the number of keys 2 of the keyboard device 1 is to be changed e.g. due to a model change of the electronic piano, it is possible to flexibly cope with the model change by using a plurality of hammer supports 4 corresponding in number to the keys 2.

In a case where the length of the key is to be changed following a design change, such as a model change, of the electronic piano, by achieving commonality of each of the component parts of the keyboard device 1 except the ribs 14 between before or after the design change and then manufacturing the ribs 14 according to the length of the key 2, it is possible to suppress an increase in manufacturing costs due to the design change. Further, since the front, center, and rear rails 11, 12, and 13 of the keyboard chassis 3 are independent of each other, it is possible not only to freely set spaces between the rails 11, 12, and 13 in the front-rear direction, but also to freely set the position of the keyframe center 23 mounted on the center rail 12 between the front rail 11 and the rear rail 13. This makes it possible to flexibly cope with changes in the key length and the position of a support for swinging movement of each key and enhance the degree of freedom of design.

Furthermore, since the center rail 12 has the leg portion 12*b* held in abutment with the keybed 8, it is possible not only to reinforce the rigidity of the keyframe center-mounting portion 12*a* by the leg portion 12*b*, but also to stably hold the keyframe center 23 placed on the keyframe center-mounting portion 12*a*, while maintaining a fixed space between the keyframe center 23 and the keybed 8. Therefore, it is possible to maintain uniformity in height of the keys supported on the keyframe center 23 and excellent touch feeling.

Note that that the present invention is by no means limited to the embodiment described above, but it can be practiced in various forms. For example, although in the above-described embodiment, the hammer support 4 is made of ABS resin by way of example, this is not limitative, but any other material can be used insofar as the material contains a synthetic resin that can ensure sufficient rigidity.

For example, it is possible to employ a fiber-reinforced plastic comprising a reinforcing material, such as carbon fiber, glass fiber, or aramid fiber, and a synthetic resin, such as phenol resin, epoxy resin, or polyester resin. When such fiber-reinforced plastic is employed as a material for forming the hammer support 4, it is possible to further enhance the rigidity of the hammer support 4 by rigid properties of the material itself. Further, since the rigidity of the hammer support 4 can be enhanced, it is possible to reduce the number of the partition walls 32 to thereby achieve reduction of weight of the hammer support.

The detailed construction of the keyboard chassis 3 and the hammer support 4 of the keyboard device 1 in the above-described embodiment is also given by way of example, and it can be changed, as desired, within the subject matter of the present invention.

It is further understood by those skilled in the art that the foregoing is a preferred embodiment of the invention, and that various changes and modifications may be made without departing from the spirit and scope thereof.

What is claimed is:

1. A keyboard device for an electronic keyboard instrument comprising:

a plurality of keys each extending in a front-rear direction and configured to be swingable about a support located at or close to a center thereof in the front-rear direction, said plurality of keys being arranged side by side in a left-right direction;

a hammer support disposed rearward of said keys;

a plurality of hammers pivotally supported by said hammer support, each hammer being in abutment with a rear end of an associated one of said keys and configured to be pivotally moved in accordance with depression of said associated key;

a key switch including a plurality of switch bodies that are provided in association with said hammers, respectively, and a switch board that has said switch bodies attached thereto and is mounted to said hammer support, said key switch detecting key depression information on a key by having an associated one of said switch bodies pressed by an associated one of said hammers pivotally moved by depression of said key;

a plurality of fulcrum shaft portions that are arranged in a straight line along an axis extending horizontally in the left-right direction, and have said hammers engaged therewith, respectively;

a stopper portion that restricts pivotal movement of one of said hammers which is being pivotally moved by depression of said associated key, by having said hammer abutted thereon; and a plurality of partition walls each formed in a manner to partition adjacent two of said fulcrum shaft portions and configured to reinforce said hammer support, wherein said hammer support includes a hammer supporting part for supporting said hammers, and a switch mounting part to which said key switch is mounted, and said hammer support is formed by an injection molded article made of a synthetic resin.

2. The keyboard device according to claim 1, wherein the synthetic resin is fiber-reinforced plastic.

3. The keyboard device according to claim 1, wherein said hammer support comprises of a plurality of hammer supports, wherein each of said plurality of hammer supports corresponds to one octave at the maximum, and said plurality of hammer supports are arranged side by side in the left-right direction.

4. The keyboard device according to claim 2, wherein said hammer support comprises of a plurality of hammer supports, wherein each of said plurality of hammer supports corresponds to one octave at the maximum, and said plurality of hammer supports are arranged side by side in the left-right direction.

5. The keyboard device according to claim 3, further comprising:

a plurality of metal connecting members that extend in the left-right direction over an entire length of said hammer supports and arranged in a manner spaced from each other, for connecting said hammer supports; and a grounded metal reinforcing member that connects said connecting members for reinforcing rigidity of said hammer supports.

6. The keyboard device according to claim 4, further comprising:

a plurality of metal connecting members that extend in the left-right direction over an entire length of said hammer supports and arranged in a manner spaced from each other, for connecting said hammer supports; and a grounded metal reinforcing member that connects said connecting members for reinforcing rigidity of said hammer supports.

7. A keyboard device for an electronic keyboard instrument comprising:

a keyboard chassis made of a metal;

a keyframe center made of a synthetic resin which is mounted on said keyboard chassis in a manner extending in a left-right direction and having a plurality of balance pins erected in a manner arranged side by side in the left-right direction;

a plurality of keys, each extending in a front-rear direction and engaged with an associated one of said balance pins via a balance pin hole formed at or near a center of said each key in the front-rear direction, and being swingably supported on said keyframe center using the balance pin as a support, said keys being arranged side by side in the left-right direction;

a hammer support connected to a rear end of said keyboard chassis;

a plurality of hammers pivotally supported by said hammer support, each hammer being in abutment with a rear end of an associated one of said keys and configured to be pivotally moved in accordance with depression of said associated key;

a key switch including a plurality of switch bodies that are provided in association with said hammers, respectively, and a switch board that has said switch bodies attached thereto and is mounted to said hammer support, said key switch detecting key depression information on a key by having an associated one of said switch bodies pressed by an associated one of said hammers pivotally moved by depression of said key;

a plurality of fulcrum shaft portions that are arranged in a straight line along an axis extending horizontally in the left-right direction, and have said hammers engaged therewith, respectively;

a stopper portion that restricts pivotal movement of one of said hammers which is being pivotally moved by depression of said associated key, by having said hammer abutted thereon; and a plurality of partition walls each formed in a manner to, partition adjacent two of said fulcrum shaft portions and configured to reinforce rigidity of said hammer support, wherein said hammer support includes a hammer supporting part for supporting said hammers, and a switch mounting part to which said key switch is mounted, and said hammer support is formed by an injection molded article made of a synthetic resin.

8. The keyboard device according to claim 7, wherein said keyboard chassis has a rear rail provided on a rear end thereof in a manner extending in the left-right direction, and wherein said hammer support is connected to said rear rail with a first screw screwed in along an axis extending in a vertical direction and a second screw screwed in along an axis extending in a front-rear direction.

9. The keyboard device according to claim 8, wherein said keyboard chassis has a plurality of ribs each extending in the front-rear direction and arranged in a manner spaced from each other in the left-right direction, and wherein said rear rail is connected to each of the ribs with a third screw screwed in along an axis extending in the vertical direction and a fourth screw screwed in along an axis extending in the front-rear direction.

10. A keyboard device for an electronic keyboard instrument comprising:

a keybed;

a keyboard chassis having a front rail, a center rail, and a rear rail, each extending in a left-right direction and arranged in a manner spaced from each other in a front-rear direction, and a plurality of connecting members extending in the front-rear direction and arranged in a manner spaced from each other in the left-right direction, for connecting said front rail, said center rail, and said rear rail, wherein said front rail, said rear rail, and said center rail are connected to said connecting members with said front rail and said rear rail placed on said keybed and said center rail placed on said connecting members;

a keyframe center extending in a lengthwise direction of said center rail and mounted on said center rail in a state placed thereon, said keyframe center having a plurality of balance pins erected thereon in a manner arranged side by side in the lengthwise direction of the center rail; and a plurality of keys each extending in a front-rear direction, each key being engaged with an associated one of said balance pins via a balance pin hole formed therethrough at a predetermined location in the front-rear direction and being swingably supported on said keyframe center using the balance pin as a support, said keys being arranged side by side in the left-right direction.

11. The keyboard device according to claim 10, wherein said center rail includes:

a keyframe center-mounting portion extending in the lengthwise direction of said center rail and having said keyframe center mounted thereon, and connected to said connecting members in a state placed thereon, and a leg portion extending in the lengthwise direction of said center rail between adjacent ones of said connecting members, extending downward from said keyframe center-mounting portion, and being configured to be in abutment with said keybed to reinforce rigidity of said keyframe center-mounting portion.

* * * * *